US005377656A

United States Patent [19]

Lewinski et al.

[11] Patent Number: 5,377,656

[45] Date of Patent: Jan. 3, 1995

[54] TOY GUN

[75] Inventors: David P. Lewinski, Cincinnati; Ronald C. Boyle, Amelia, both of Ohio

[73] Assignee: Tonka Corporation, Pawtucket, R.I.

[21] Appl. No.: 59,261

[22] Filed: May 10, 1993

[51] Int. Cl.[6] ..... F41B 11/14; F41B 9/00

[52] U.S. Cl. ..... 124/65; 124/56; 124/63; 222/79

[58] Field of Search ..... 124/65, 66, 64, 63, 124/60, 56, 37, 83, 67; 222/79; 446/475, 473, 267

[56] References Cited

U.S. PATENT DOCUMENTS

| | | | |
|---|---|---|---|
| 1,031,526 | 7/1912 | Cloud | 124/65 |
| 1,167,178 | 1/1916 | Hill | 124/65 |
| 1,394,456 | 10/1921 | Wanat | 124/65 |
| 2,762,356 | 9/1956 | Foster | 124/65 |
| 2,938,512 | 5/1960 | Smolen . | |
| 3,087,481 | 4/1963 | Foster | 222/79 |
| 3,415,420 | 12/1968 | White . | |
| 4,892,081 | 1/1990 | Moormann . | |
| 5,115,794 | 5/1992 | Morrmann . | |
| 5,241,944 | 9/1993 | Rappaport | 222/79 |

FOREIGN PATENT DOCUMENTS

| | | | |
|---|---|---|---|
| 1017630 | 12/1952 | France | 124/65 |

*Primary Examiner*—Randolph A. Reese
*Assistant Examiner*—Anthony Knight
*Attorney, Agent, or Firm*—Kurt R. Benson

[57] ABSTRACT

A toy gun includes a ball holding member and a piston and cylinder assembly for producing blasts of compressed air in order to launch soft foam balls from the ball holding member. The gun further includes a water supply assembly for supplying water to the piston and cylinder assembly so that a quantity of dispersed water is expelled from the gun when a ball is launched therefrom.

8 Claims, 5 Drawing Sheets

TOY GUN

BACKGROUND AND SUMMARY OF THE INVENTION

The instant invention relates to toy guns which are operative for launching projectiles and more particularly to a toy gun which is operative for launching a projectile and for simultaneously expelling a quantity of water therewith.

A variety of different types of projectile launching toy guns have been heretofore available. However, it has been found that toy guns which are capable of launching relatively light weight balls, such as resilient foam balls, have a particularly high level of appeal. For example, the toy gun disclosed in the U.S. Pat. Nos. to Mooman 4,892,081 and 5,115,794 have been found to be extremely popular. Further, because they are operative for shooting relatively soft foam balls, rather than hard projectiles, they are relatively safe, and they can be effectively utilized without causing injury to persons or damage to objects which they impact. Various other types of toy guns have also been heretofore available, including guns which are capable of shooting streams of water and guns which are capable of shooting both projectiles and streams of water. The devices disclosed in the U.S. Pat. Nos. to Smolen 2,938,512 and White 3,415,420 are exemplary of the heretofore available toy guns which have been operative for shooting both water and projectiles. However, the prior art has failed to provide an effective toy gun which is operable for simultaneously launching a projectile and expelling a quantity of water therewith from a single launching station in the manner of the toy gun of the instant invention. Hence, the prior art devices, including those disclosed in the aforementioned U.S. Pat. Nos. to Smolen and White, are believed to be of only general interest with respect to the subject invention.

The instant invention provides a toy gun which is capable of simultaneously launching a projectile and ejecting quantity of water in a highly effective manner. Specifically, the instant invention provides a toy gun comprising a projectile holding member which is operative for releasably holding a projectile at a launching station so that the projectile is launchible in a forward direction therefrom and a piston and cylinder assembly which is operative for producing and supplying individual blasts of compressed air to the launching station in order to launch the projectile from the projectile holding member. The toy gun further includes a mechanism for supplying a quantity of water to the launching station so that the water is expelled forwardly therefrom when the projectile 15 launched by a blast of compressed air. The projectile preferably comprises a soft foam ball, and the water is preferably supplied to the cylinder of the piston and cylinder assembly so that the water is expelled forwardly with a projectile when a blast of compressed air is delivered to the launching station. The projectile is preferably receivable in sealed engagement in the projectile holding member in order to initially resists being launched by a blast of compressed air, although the projectile is preferably resiliently yieldable to enable it to be launched from the holding member. However, because the projectile is preferably receivable in sealed engagement with the holding member to initially resist being launched by a blast of compressed air, the water which is expelled from the launching station is dispersed as it is expelled from the ball holding member. Further, the piston and cylinder assembly is preferably operative for drawing a quantity of water into the cylinder as the piston is drawn rearwardly in the cylinder and for then expelling the water and launching a projectile as the piston is moved forwardly in the cylinder. The ball is preferably also receivable in sealed engagement with a projectile holding member to create a partial vacuum in the cylinder as the piston is drawn rearwardly therein in order to draw water into the cylinder from the water supply assembly. Accordingly, the piston and cylinder assembly not only functions to produce blasts of compressed air, but it preferably also functions to pump water from the water supply mechanism so that the water is drawn into the cylinder during a rearward stroke of the piston in the cylinder.

It has been found that the toy gun of the instant invention can be effectively utilized for launching projectiles, such as foam balls, and for ejecting quantities of water along with the balls as they are launched. Specifically, because the toy gun includes a water supply mechanism which is actuated as the piston is drawn rearwardly in the cylinder for drawing water into the cylinder, a quantity of water is reliably expelled and dispersed as a projectile is launched from the projectile holding member. Hence, the toy gun of the instant invention is capable of effectively launching projectiles and for expelling a spray of water in a forward direction each time a projectile is launched.

Accordingly, it is a primary object of the instant invention to provide an effective toy gun which is capable of launching projectiles and simultaneously expelling water.

Another object of the instant invention is to provide a toy gun which is operative for launching foam balls from a launching station and for expelling water along with the foam balls as they are launched from the launching station.

An even still further object of the instant invention is to provide a toy gun comprising a piston and cylinder assembly which is operative for producing blasts of compressed air for launching balls from the gun and for simultaneously pumping and expelling water from the gun.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
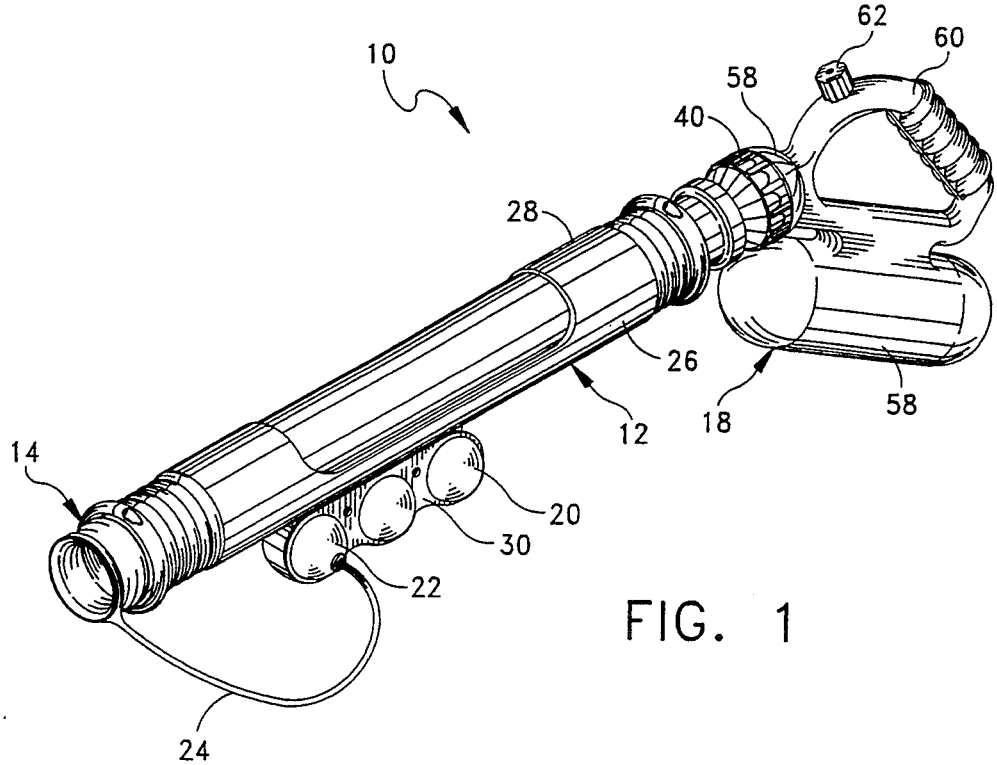
FIG. 1 is a perspective view of the toy gun of the instant invention.
Figure 2:
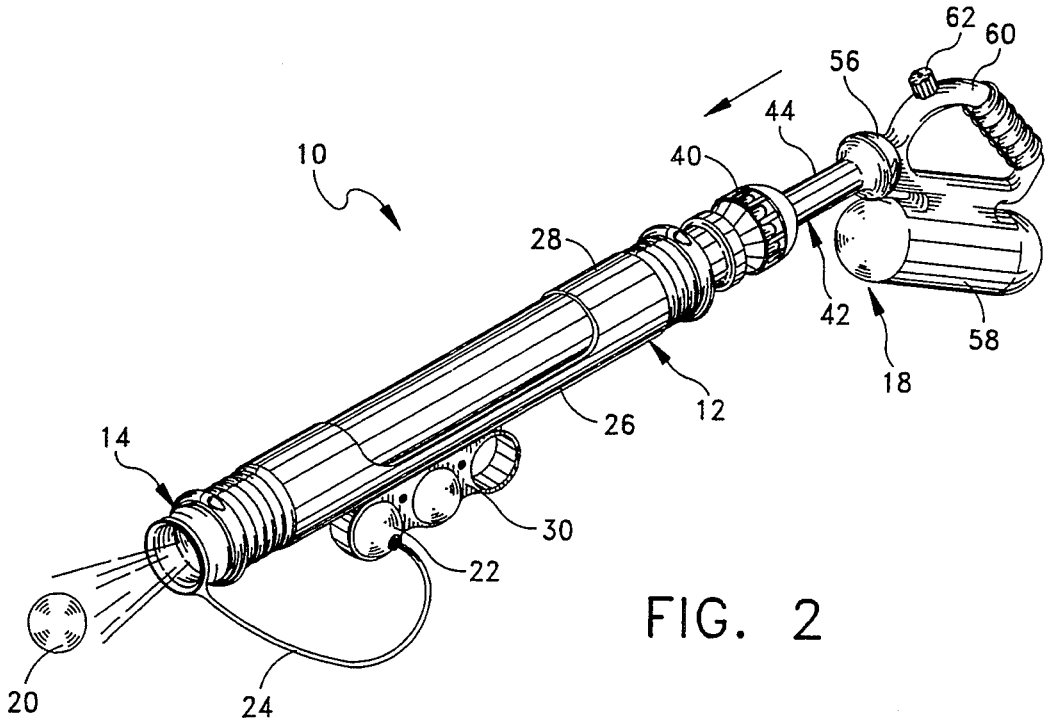
FIG. 2 is a perspective view of the toy gun as it is operated for launching a ball and expelling a quantity of water therewith.
Figure 3:
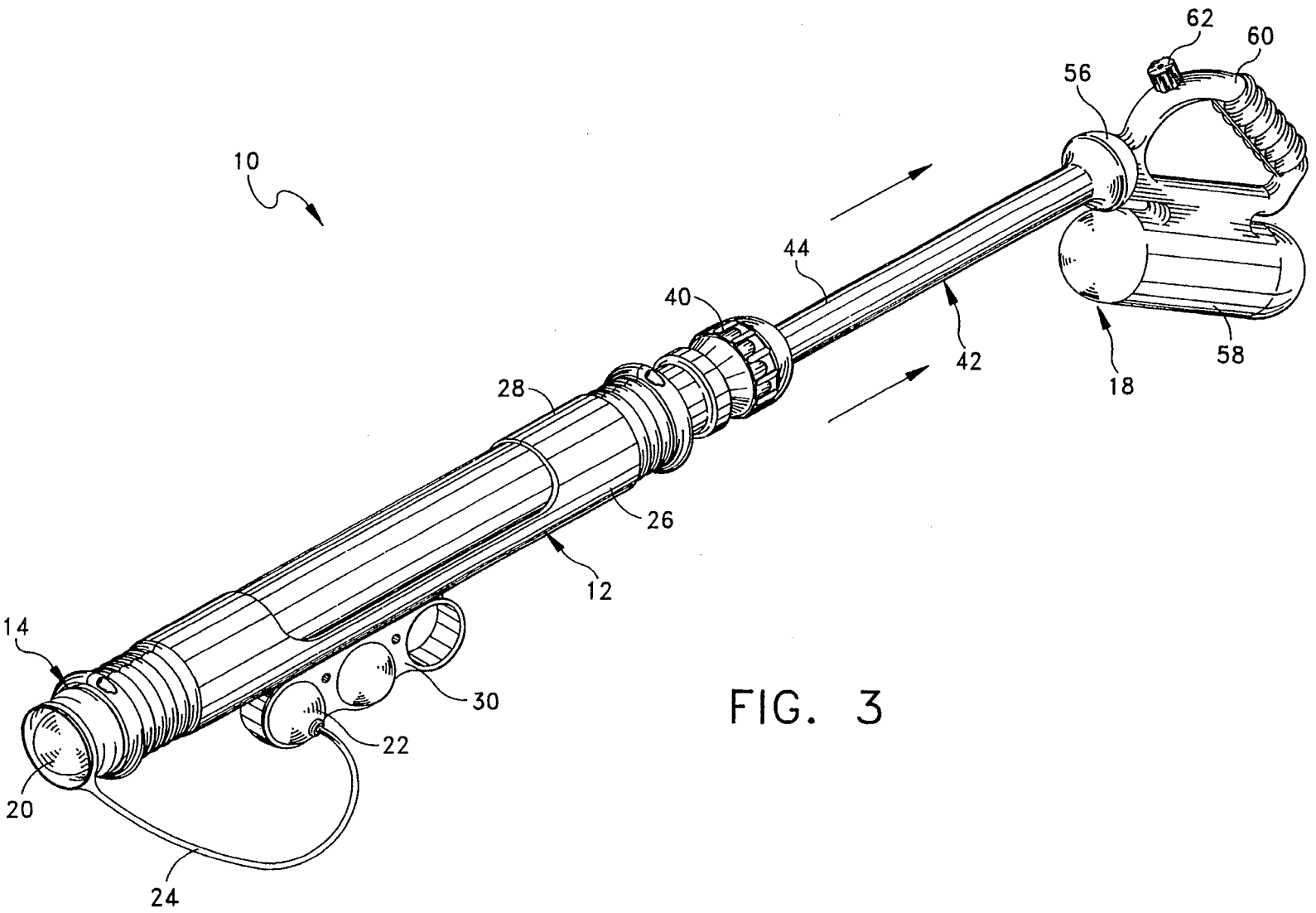
FIG. 3 is a perspective view of the gun with the piston in a rearward position in the cylinder.

Referring now to the drawings, the toy gun of the instant invention is illustrated and generally indicated at 10 in FIGS. 1–5. The toy gun 10 comprises an outer housing generally indicated at 12, a ball holding member generally indicated at 14, a piston and cylinder assembly generally indicated at 16, and a water supply assembly generally indicated at 18. The toy gun 10 is operative in combination with toy balls 20 which are dimensioned to be received in the ball holding member 14, and during use of the toy gun 10 the piston and cylinder assembly 16 is operative for producing blasts of compressed air for individually launching the balls 20 from the ball holding member 14. Further, the water supply mechanism 18 is operative for supplying water to the piston and cylinder assembly 16 so that a quantity of dispersed water is ejected with the ball 20 when a blast of compressed air is delivered to the ball holding member 14 by the piston and cylinder assembly 16 for launching the ball therefrom.

The balls 20 preferably comprise soft foam balls which are resiliently yieldable or deformable to enable them to be launched from the ball holding member 14, as will hereinafter be more fully set forth. Further, as illustrated, the gun 10 is also operative in combination with a ball 22 having a tether 24 which is received on the ball holding member 14 for retaining the ball 22 once it has been launched from the gun 10.

The housing 12 comprises a split housing which including a pair of housing halves 26 and 28 which cooperate to define a tubular housing for containing the piston and cylinder assembly 16. The housing halves 26 and 28, further cooperate to define a ball storage member 30 which is operative for holding a plurality of the balls 20 and one of the balls 22 prior to launching them from the gun 10 as illustrated.

Figure 4:
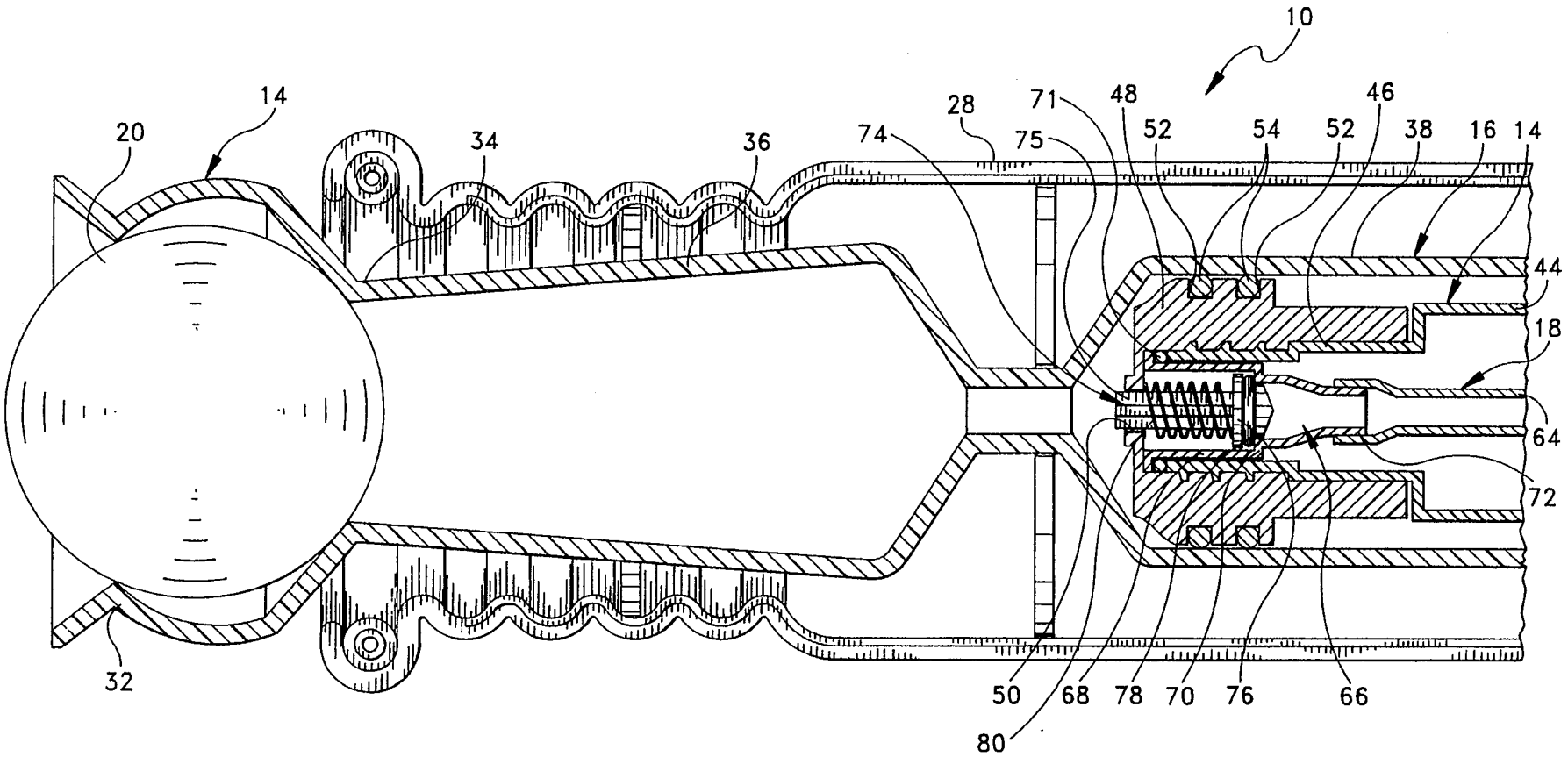
FIG. 4 is a sectional view with the piston in a forward position in the cylinder.
Figure 5:
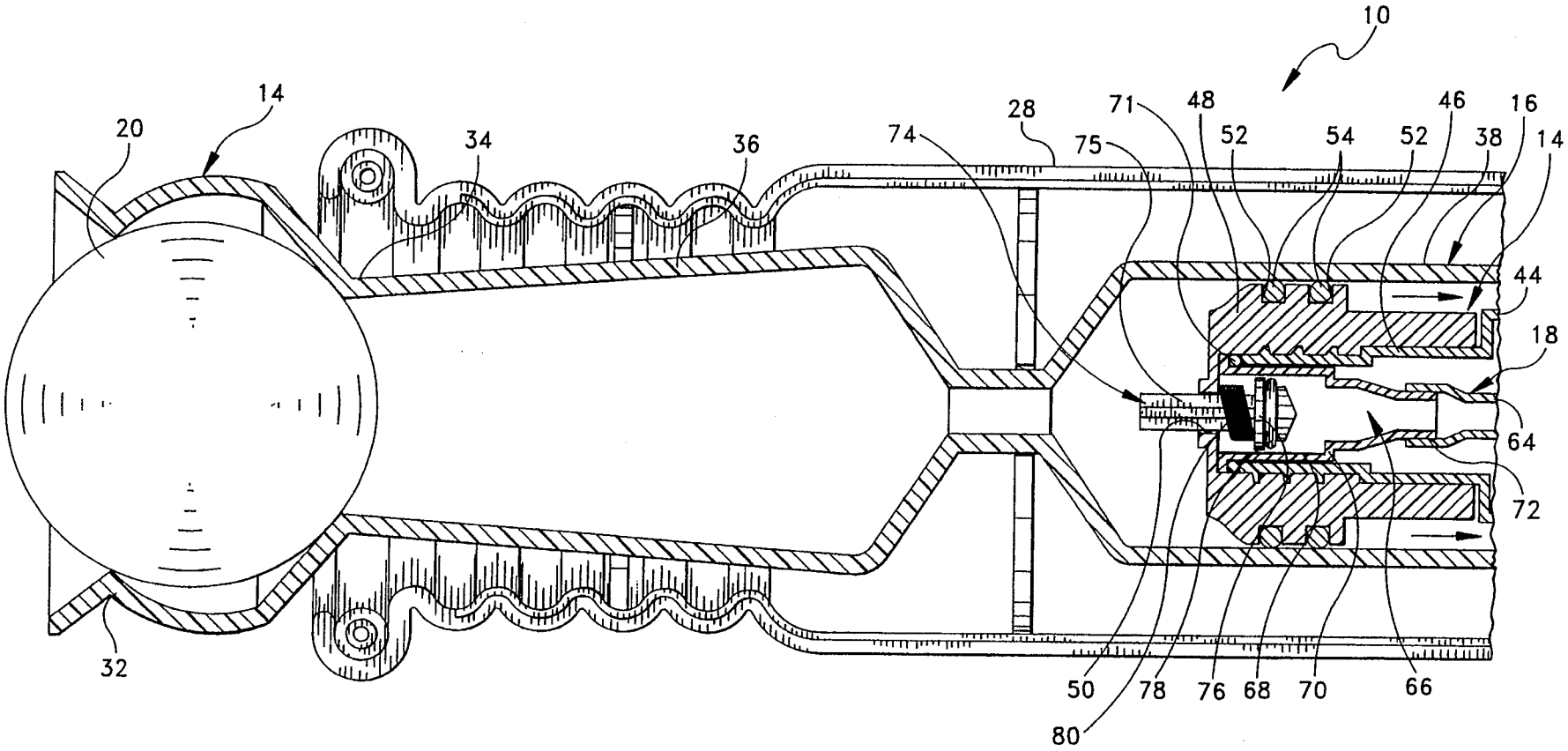
FIG. 5 is a similar sectional view as the piston is drawn rearwardly in the cylinder.
Figure 6:
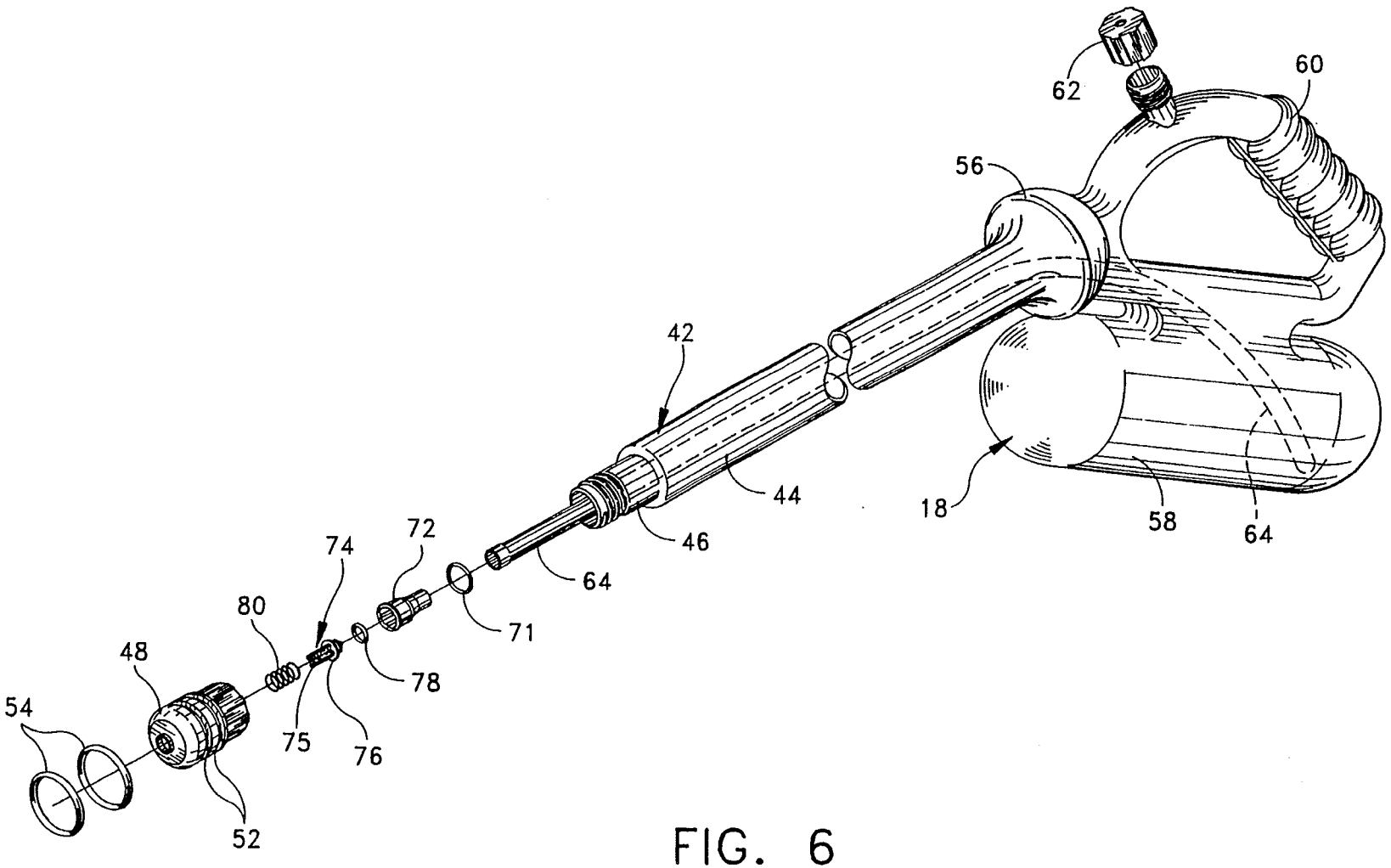
FIG. 6 is a exploded perspective view of the piston and water supply assembly.

The ball holding member 14 is illustrated most clearly in FIG. 4 and 5. In this regard, the ball holding member 14 is similar to the ball holding members disclosed in the aforementioned U.S. Pat. Nos. to Moorman 4,892,081 and 5,115,794. The ball holding member 14 includes a reduced forward neck portion 32 and a reduced rear section 34, both of which are smaller in diameter than the balls 20 and 22. Accordingly, as illustrated, when one of the balls 20 or 22 is received in ball holding member 14, the ball 20 or 22 is normally received in sealed engagement with both the neck 32 and the rear portion 34. Further, the ball 20 or 22 must be resiliently deformed slightly to be launched from the ball holding member 14 by a blast of air. Accordingly, the ball holding member 14 operates to initially resist launching the ball 20 or 22 therefrom when a blast of air is delivered to the ball holding member 14. However, when the compressed air delivered to the ball holding member 14 reaches a predetermined level of compression, the ball 20 or 22 is resiliently deformed so that it is launched from the ball holding member 14 with a sufficient propelling force to carry it a significant distance. The ball holding member 14 further includes a rear accumulator chamber 36 which extends rearwardly from the reduced rear section 34 for accumulating a quantity of compressed air so that sufficient compressed air is available for discharging or launching the ball 20 or 22 from the gun 10.

The piston and cylinder assembly 16 includes a cylinder portion 38 which is integrally formed with the ball holding member 14 so that it is operative for delivering compressed air to the accumulator chamber 36. The cylinder 38 is of elongated configuration and it is received in the housing 12 as illustrated. The cylinder 38 includes a rear collar 40 at the rear end thereof. The piston and cylinder assembly 16 further includes a piston generally indicated at 42 which travels in the cylinder 38 for both producing blasts of compressed air in order to launch the individual balls 20 or 22 from the ball holding member 14 and to draw water into the cylinder 38 from the water supply mechanism 18. The piston 42 includes an elongated piston element 44 having a reduced threaded end portion 46 and a forward end cap 48 which is received in threaded engagement on the end portion 46. The end cap 48 has an axial aperture 50 therein, and it also has a pair of annular grooves 52 formed therein containing O-rings 54. The O-rings 54 slidably and sealingly engage the inner wall of the cylinder member 38 so that as the piston 42 is advanced forwardly in the cylinder member 38, the piston 42 operates to compress the air therein and to force compressed air into the accumulator chamber 36. Further, as the piston 42 is advanced forwardly in the cylinder 38, the ball holding member 14 initially resists releasing a ball 20 or 22 therefrom until the piston 42 has been advanced forwardly far enough to develop a sufficient pressure in the accumulator chamber 36 to slightly deform the ball 20 or 22 so that it passes through the reduced neck portion 32. The piston element 44 includes an enlarged end portion 56, and the collar 40 and the O-rings 54 cooperate to guide the piston 42 in its reciprocal movement in the cylinder 38. As illustrated in FIG. 1, when the piston 42 is in a forwardly advanced position in the cylinder 38, the enlarged rear portion 56 abuts the collar 40.

The water supply assembly 18 comprises a reservoir 58 which is integrally formed with a handle 60. A supply cap 62 is formed on the handle 60 for filling the reservoir 58 and the handle 60 with a supply of water. Also included in the water supply assembly 18 is a supply tube 64 which extends from the lower end of the reservoir 58 through the piston element 44 to the reduced forward end portion 46. A check valve assembly generally indicated at 66 is received in the forward end .cap 48 and connected to the supply tube 64 for assuring that water is only supplied to the cylinder 38 during rearward movement of the piston 42 and also for assuring that compressed air from the piston and cylinder assembly 16 does not back-up into the water supply assembly 18 during forward movement of the piston 42 in the cylinder 38. The check valve assembly 66 comprises a tubular member 68 having a reduced seat 70 and a further reduced end portion 72 which is connected to the supply tube 64. The check valve assembly 66 further includes a valve element 74 comprising a stem portion 75 and an enlarged disk portion 76. The stem portion 75 passes through the aperture 50, and it has an X or cross-shaped cross section so that air and water can nevertheless pass freely through the aperture 50. The valve element 74 further includes an O-ring 78 which is received behind the circular disk portion 76. A coil spring 80 is received on the stem portion 75 so that it engages the end cap 48 proximal the aperture. 50 and so that it also engages the disk portion 76 to bias the valve element 74 to a position wherein the O-ring 78 is received in sealed engagement with the seat 70. Accordingly, the valve element 74 prevents compressed air from backing up into the water supply assembly 18 through the supply tube 64 when the piston 42 is advanced in a forward direction in the cylinder 38. However, when the piston 42 is drawn rearwardly in the cylinder 38, a partial vacuum is created in the cylinder 38 and in the supply chamber 36. This is because when a ball 20 or 22 is received in the ball holding member 14, the ball 20 or 22 is received in sealed engagement against the rear reduced portion 34 so that only a relatively small quantity of air is drawn inwardly through the ball holding member 14. As a result, the partial vacuum which is created in the cylinder 38 causes the valve element 74 to be disengaged from the seat 70 so that the vacuum operates to draw water from the reservoir 58 through the supply tube 74 and into the cylinder 38 through the aperture 50 around the valve stem 75. In this regard, it should be noted that even though the ball 20 or 22 operates to seal the forward end of the accumulator chamber 36 a certain amount of air is nevertheless drawn inwardly through the ball holding member 14 and also through the water supply assembly 18. Accordingly, when the piston 42 is drawn rearwardly to its rear position in the cylinder 38 there is still a sufficient amount of air in the cylinder 38 so that the air can be compressed to launch a ball 20 or 22 from the ball holding member 14 as the piston 42 is thereafter advanced forwardly in the cylinder 38.

Accordingly, for use in operation of the toy gun 10 the water supply cap 62, which has a vent aperture therein, is removed to fill the reservoir 58, and thereafter the supply cap 62 is replaced to it original position. A ball 20 or 22 is then inserted into the ball holding member 14 by slightly resiliently deforming the ball 20 or 22 as hereinabove set forth. The piston 42 is then drawn rearwardly in the cylinder 38 so that a partial vacuum is produced in the cylinder 38 causing the check valve element 74 to be disengaged from the seat 70 so that water is drawn inwardly into the cylinder 38 from the water supply assembly 18. When the piston reaches a rearward position in the cylinder 38, it can then be advanced forwardly in the cylinder 38 to launch the ball 20 or 22 from the ball holding member 14 and to also eject a spray of dispersed water from the ball holding member 14. In this regard, because the ball 20 or 22 initially resists being launched from the ball holding member 14 until a sufficient pressure has accumulated in the accumulator chamber 36, the ball 20 or 22 is launched with a loud popping sound and the gun 10 is capable of carrying the ball 20 a significant distance. On the other hand, if the ball 22 is launched from the ball holding member 14, the tether 24 will retain it against traveling a significant distance. However, because of the pressure required to launch the ball 20 or 22 from the ball holding member 14 and because of the manner in which the water from the water supply assembly 18 is injected into the ball holding member 14 from the piston 38, the water is ejected as a dispersed spray which also travels a significant distance.

It is seen therefore that the instant invention provides an effective toy gun which is capable of both launching projectiles and ejecting quantities of water. The toy gun is operative with a reliable and simple mechanism which utilizes a piston and cylinder assembly for both producing blasts of Compressed air and for drawing water from a water supply mechanism. As a result of this simple mechanism the toy gun of the instant invention is easy to operate, and it has an extremely high level of play value. Hence, the toy gun of the instant invention represents a significant advancement in the toy art which has substantial commercial merit.

What is claimed:

1. A toy game comprising (a) a projectile;

(b) a piston and cylinder assembly for producing and supplying blasts of compressed air to a launching station for launching said projectile therefrom in a forward direction ,said piston and cylinder assembly including a cylinder, a piston in said cylinder and one-way air inlet valve means for allowing air to be drawn into said cylinder as said piston is retracted therein but preventing the escape of air from said cylinder through said air inlet valve means when said piston is advanced in said cylinder;

(c) projectile holding means for receiving and releasably holding said projectile at said launching station, said projectile holding means being responsive to the application of a blast of compressed air thereto from said piston and cylinder assembly for releasing said projectile so that said projectile is launched from said launching station; and (d) means separate from said air inlet valve means for supplying a quantity of water to said launching station so that said water is expelled forwardly from said launching station with said projectile by said blast of compressed air.

2. In the toy gun of claim 1, said projectile comprising a ball, said quantity of water following said ball as said ball is launched from said launching station.

3. In the toy gun of claim 1, said means for supplying a quantity of water supplying said quantity of water to said piston and cylinder assembly so that said quantity of water is advanced to said launching station and expelled forwardly by said blast of compressed air with said projectile.

4. In the toy gun of claim 1, said piston being advanceable forwardly in said cylinder for individually producing said blasts of compressed air, said means for supplying a quantity of water supplying said quantity of water to said cylinder so that said quantity of water is advanced to said launching station and expelled by said blast of compressed air with said projectile.

5. In the toy gun of claim 4, said projectile being receivable in sealed engagement in said projectile holding means to initially resist being launched by said blast of compressed air, one of said projectile and said projectile holding means being resiliently yieldable to enable said projectile to be launched from said projectile holding means with said quantity of water when said blast of compressed air reaches a predetermined compressed level, whereby said quantity of water is dispersed as it is expelled from said ball holding means.

6. In the toy gun of claim 5, said projectile comprising a resiliently yieldable ball, said projectile holding means being substantially nonyieldable.

7. In the toy gun of claim 1, said piston being reciprocally moveable in forward and rearward directions in said cylinder, said piston and cylinder cooperating to produce a blast of compressed air when said piston is moved forwardly in said cylinder and cooperating to draw water into said cylinder from said means for supplying a quantity of water as said piston is drawn rearwardly in said cylinder.

8. In the toy gun of claim 7, said projectile comprising a ball, said ball being receivable in sealed engagement in said projectile holding means to initially resist being launched by said blast of compressed air as said piston is advanced forwardly in said cylinder, said ball also being receivable in sealed engagement with said projectile holding means to create a partial vacuum in said cylinder as said piston is drawn rearwardly therein to draw water into said cylinder from said means for supplying a quantity of water.

* * * * *